US007561819B2

(12) United States Patent
Koizumi et al.

(10) Patent No.: US 7,561,819 B2
(45) Date of Patent: Jul. 14, 2009

(54) BELT CLEANING DEVICE HAVING CLEANING BLADE FOR IMAGE FORMING APPARATUS

(75) Inventors: Susumu Koizumi, Izunokuni (JP); Masaharu Kitagawa, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 218 days.

(21) Appl. No.: 11/675,423

(22) Filed: Feb. 15, 2007

(65) Prior Publication Data

US 2007/0196125 A1 Aug. 23, 2007

(30) Foreign Application Priority Data

Feb. 20, 2006 (JP) ..... 2006-042772
Feb. 20, 2006 (JP) ..... 2006-042773
Feb. 20, 2006 (JP) ..... 2006-042774

(51) Int. Cl.
*G03G 15/16* (2006.01)

(52) U.S. Cl. ..... 399/101; 399/123

(58) Field of Classification Search ..... 399/123, 399/345, 350, 351, 101, 302, 308
See application file for complete search history.

(56) References Cited

U.S. PATENT DOCUMENTS 5,887,228 A * 3/1999 Motohashi et al. ..... 399/111

FOREIGN PATENT DOCUMENTS

| | | |
|---|---|---|
| JP | 2001-255750 | 9/2001 |
| JP | 2003-316107 | 11/2003 |
| JP | 2005-181820 | 7/2005 |

* cited by examiner

*Primary Examiner*—Quana M Grainger
(74) *Attorney, Agent, or Firm*—Turocy & Watson, LLP

(57) ABSTRACT

A pressure release cam and a boomerang cam are provided. The pressure release cam is interlocked with a belt cleaner when the latter is turned, whereas the boomerang cam is interlocked with the belt cleaner when the latter is mounted in position. As the belt cleaner is turned to move the cleaning blade away from an intermediate transfer belt, the pressure release cam is moved to a release position to release the cleaning member from the pressure applied to it by a pushing unit. The pressure applied by the pushing unit to the cleaning member is restored when the boomerang cam is turned as a motion interlocked with the operation of mounting the belt cleaner in position and the pressure release cam is taken out from the release position. The cleaner frame is provided with first and second guide rails for allowing the belt cleaner to slide and a toner anti-fall dish.

13 Claims, 8 Drawing Sheets

BELT CLEANING DEVICE HAVING CLEANING BLADE FOR IMAGE FORMING APPARATUS

CROSS REFERENCE TO RELATED APPLICATION

This application is based upon and claims the benefit of priority from prior Japanese Patent Application No. 2006-42772 filed on Feb. 20, 2006, No. 2006-42773 filed on Feb. 20, 2006 and No. 2006-42774 filed on Feb. 20, 2006, the entire contents of which are incorporated herein by reference.

BACKGROUND OF THE INVENTION

1. Field of the Invention

This invention relates to an image forming apparatus such as an electronic photography type copying machine or printer for obtaining an image by means of an endless transfer belt that has a cleaning member for cleaning the surface of a transfer belt after a transfer operation.

2. Description of the Related Art

Tandem type image forming apparatus comprising a plurality of image forming units having respective photosensitive members and arranged in parallel and an endless intermediate transfer belt are known. In a tandem type image forming apparatus, the toner images formed on the respective photosensitive members are firstly transferred onto the endless intermediate transfer belt one on the other to form a single color toner image as primary transfer, which color image is then transferred onto a recording medium to produce a final color image as secondary transfer. Some tandem type image forming apparatus are equipped with a cleaning apparatus adapted to be brought into contact with the intermediate transfer belt and moved away from the latter. For example, Jpn. Pat. Publication (Kokai) No. 2001-255750 discloses such an apparatus.

In known such apparatus, a blade member is provided so as to be brought into contact with the intermediate transfer belt and moved away from the latter as an operation lever is turned. In recent years, there has been a demand for apparatus equipped with a removable cleaning apparatus that can be replaced independently relative to the intermediate transfer belt because the cleaning apparatus is in need of frequent maintenance. Such removable cleaning apparatus are required to be replaceable with ease without damaging the intermediate transfer belt.

Additionally, among tandem type image forming apparatus of the type under consideration, there are some in which the intermediate transfer belt cleaning apparatus is removably mounted in the apparatus main body. For example, Jpn. Pat. Publication (Kokai) No.2005-181820 and Jpn. Pat. Publication (Kokai) No. 2003-316107 discloses such apparatus.

In those known apparatus, the intermediate transfer member and the intermediate transfer member cleaning apparatus are integrally unitized so as to be integrally and removably mounted in the apparatus main body. Then, an anchor member that anchors the intermediate transfer member and the cleaning apparatus to the main body has to be released to take out the cleaning apparatus when performing maintenance on the cleaning apparatus that requires relatively frequent maintenance. Thus, the replacing operation requires much labor. Such apparatus are far from easy maintenance. Otherwise, the intermediate transfer belt has to be taken out from the apparatus main body when only the cleaning apparatus requires maintenance. Because the intermediate transfer belt is rather heavy, then the apparatus is also far from easy maintenance.

Therefore, it is desirable to replace a cleaning member for cleaning the belt member that is independent from the belt member in a safe and easy manner for a tandem type image forming apparatus comprising a plurality of image forming units, so as to prevent the surrounding units from being tainted by toner and improve the maintenance capability.

SUMMARY OF THE INVENTION

An aspect of the present invention is to provide a cleaning member for cleaning the belt member of an image forming apparatus that can be removably mounted in the image forming apparatus as a single unit in a condition where its cleaning blade is separated from the belt member. Thus, the cleaning member does not damage the belt member when the former is mounted in or taken out from the image forming apparatus so that the cleaning member can be safely replaced. Additionally, the cleaning member can be removably mounted in the image forming apparatus with ease and can prevent the surrounding units from being tainted by toner. Then, the maintenance capability of the cleaning member is improved.

According to an embodiment of the present invention, there is provided an image forming apparatus including: a plurality of image forming units having respectively toner image forming means for forming toner images on corresponding image carriers; an endless belt member arranged opposite to the image carriers to bear and move the toner images transferred from the image carriers as primary transfer and transfer them on a transfer medium; and a cleaning member arranged opposite to the belt member after transferring the toner image on the transfer medium and holding a cleaning blade so as to be able to bring the latter into contact and move it away from the belt member, the cleaning member being removably mounted in the image forming apparatus independently relative to the belt member; the cleaning member being adapted to be turned to move the cleaning blade away from the belt member and subsequently moved in a direction perpendicular to the running direction of the belt member so as to be removably mounted in the image forming apparatus independently relative to the belt member.

DETAILED DESCRIPTION OF THE PREFERRED EMBODIMENTS

Figure 1:
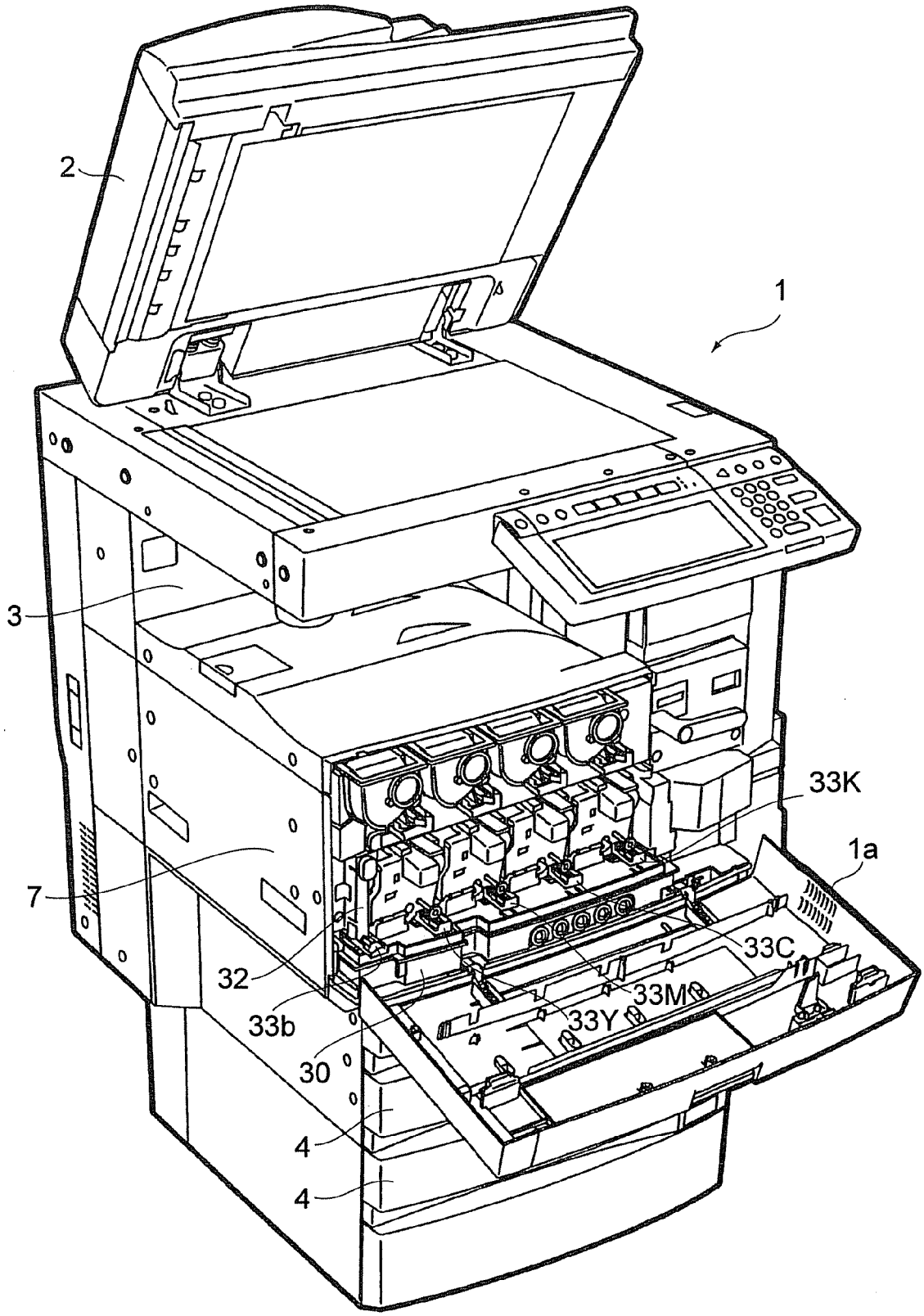
FIG. 1 is a schematic perspective view of a color copying machine that is an embodiment of the present invention with its front cover open, showing the appearance thereof.
Figure 2:
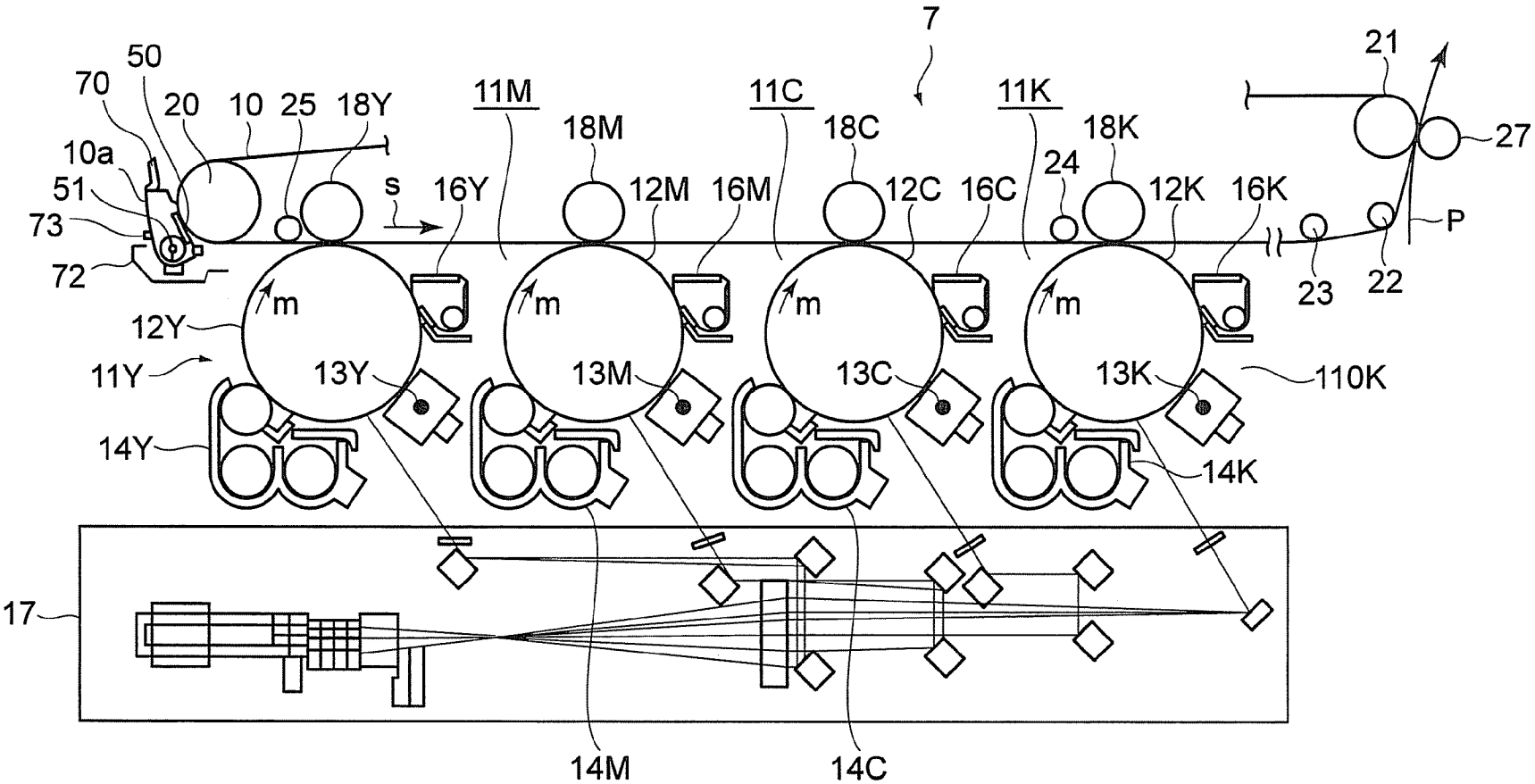
FIG. 2 is a schematic illustration of the image forming section according to the embodiment of the present invention, showing the configuration thereof.

Now, a preferred embodiment of the present invention will be described in greater detail by referring to the accompanying drawings. FIG. 1 is a schematic perspective view of a 4-unit tandem type color copying machine 1 that is an image forming apparatus according to the embodiment of the present invention with its front cover 1*a* open, showing the appearance thereof. FIG. 2 is a schematic illustration of an image forming section 7 of the color copying machine 1, showing the configuration thereof. Referring to FIGS. 1 and 2, the color copying machine 1 comprises a scanner section 2 and an inter-body sheet ejecting section 3. The color copying machine 1 also comprises four image forming units 11Y, 11M, 11C and 11K for four colors of yellow (Y), magenta (M), cyan (C) and black (K). The four image forming units 11Y, 11M, 11C and 11K are arranged in parallel relative to each other along and under an intermediate transfer belt 10 which is an endless belt member driven to turn in the direction of arrow s in FIG. 2.

The image forming units 11Y, 11M, 11C and 11K respectively include photosensitive drums 12Y, 12M, 12C and 12K that are image carriers. Electric chargers 13Y, 13M, 13C and 13K, development units 14Y, 14M, 14C and 14K, and photosensitive member cleaning apparatus 16Y, 16M, 16C and 16K are arranged respectively around the photosensitive drums 12Y, 12M, 12C and 12K in the direction of rotation thereof indicated by arrows m. The photosensitive drums 12Y, 12M, 12C and 12K are exposed respectively to laser beams emitted from a laser exposure apparatus 17 in zones from the electric chargers 13Y, 13M, 13C and 13K to the development units 14Y, 14M, 14C and 14K.

For example the electric chargers 13Y, 13M, 13C, 13K uniformly charge the entire surfaces of the respective photosensitive drums 12Y, 12M, 12C, 12K to about −700V. The development units 14Y, 14M, 14C, 14K supply the photoconductor drums 12Y, 12M, 12C, 12K with respective two component developers each comprising a toner (of yellow (Y), magenta (M), cyan (C), or black (K)) and a carrier.

The laser exposure apparatus 17 emits laser beams from its semiconductor laser element to scan the respective photosensitive drums 12Y, 12M, 12C and 12K in the axial directions of the photosensitive drums, focusing the laser beams on the photosensitive drums 12Y, 12M, 12C and 12K by way of respective focusing lens systems.

Figure 3:
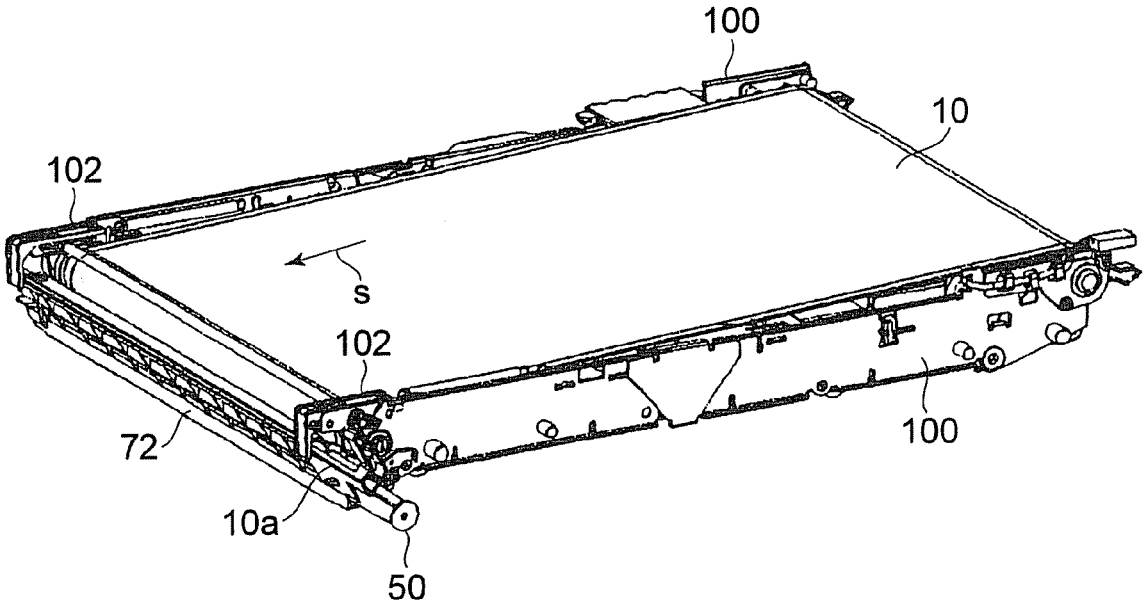
FIG. 3 is a schematic perspective view of an intermediate transfer belt and a belt cleaner according to the embodiment of the present invention.

The intermediate transfer belt 10 is made of e.g., electrically semi-conductive polyimide that is a stable material from the viewpoint of thermal resistance and abrasion resistance. The intermediate transfer belt 10 is wound around a drive roller 21, a follower roller 20 and first through fourth tension rollers 22 through 25 that are supported at the opposite ends thereof by a belt frame 100 as shown in FIG. 3. Primary transfer voltages are applied to the primary transfer position of the intermediate transfer belt 10 respectively at the positions located vis-à-vis the photosensitive drums 12Y, 12M, 12C and 12K by means of primary transfer rollers 18Y, 18M, 18C and 18K so that the toner images on the photosensitive drums 12Y, 12M, 12C and 12K are sequentially transferred onto the intermediate transfer belt 10. The photosensitive member cleaning apparatus 16Y, 16M, 16C and 16K recover the residual toners on the photosensitive drums 12Y, 12M, 12C and 12K as waste toner after the primary transfer.

A secondary transfer roller 27 is arranged to face the intermediate transfer belt 10 at the position where the intermediate transfer belt 10 is supported by the drive roller 21. A secondary transfer voltage is applied to the intermediate transfer belt 10 from the secondary transfer roller 27 at the secondary transfer position e.g., by way of a sheet of paper P that is a transfer medium supplied from a sheet feeding section 4. Then, as a result, the toner image on the intermediate transfer belt 10 is transferred onto the sheet of paper P for secondary transfer. A belt cleaner 10*a*, which is a cleaning member, is arranged opposite to the intermediate transfer belt 10 at a position downstream relative to the secondary transfer roller 27 so as to be brought into contact with and moved away from the intermediate transfer belt 10. The belt cleaner 10*a* recovers the toner remaining on the intermediate transfer belt 10 after the secondary transfer as waster toner.

The waste toner recovered by the photosensitive member cleaning apparatus 16Y, 16M, 16C and 16K and the belt cleaner 10*a* is contained in a waste toner box 30. The waste toner box 30 extends in an elongated manner on the front side of the image forming section 7 of the color copying machine 1. When the waste toner box 30 is full, it is replaced with the new one.

Figure 4:
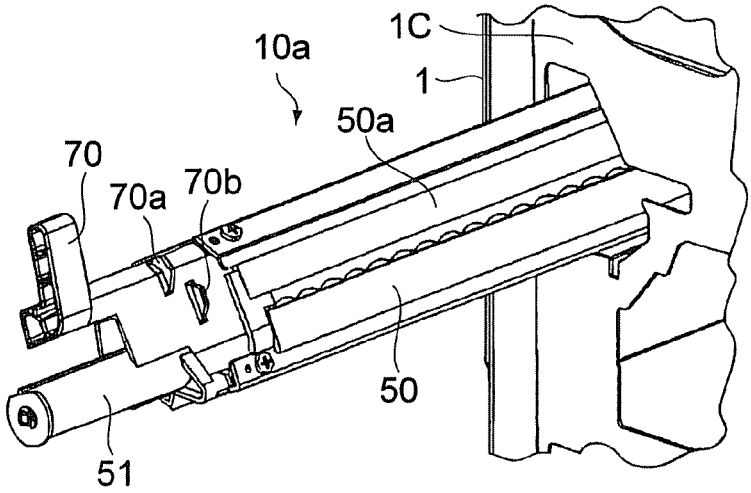
FIG. 4 is a schematic perspective view of part of the belt cleaner drawn out from the main body frame according to the embodiment of the present invention.

As shown in FIG. 4, the belt cleaner 10*a* includes a cleaning blade 50 and a recovery blade 50*a*. The cleaning blade 50 is held in sliding contact with the intermediate transfer belt 10 to recover the residual toner on the intermediate transfer belt 10. The recovery blade 50*a* prevents flying toner from leaking out from the belt cleaner 10*a* when recovering the residual toner. The waste toner recovered by the cleaning blade 50 is then conveyed to the front side by means of an auger 51. The waste toner conveyed to the front side is made to fall and flow into the waste toner box 30 by way of a duct 32.

Figure 5:
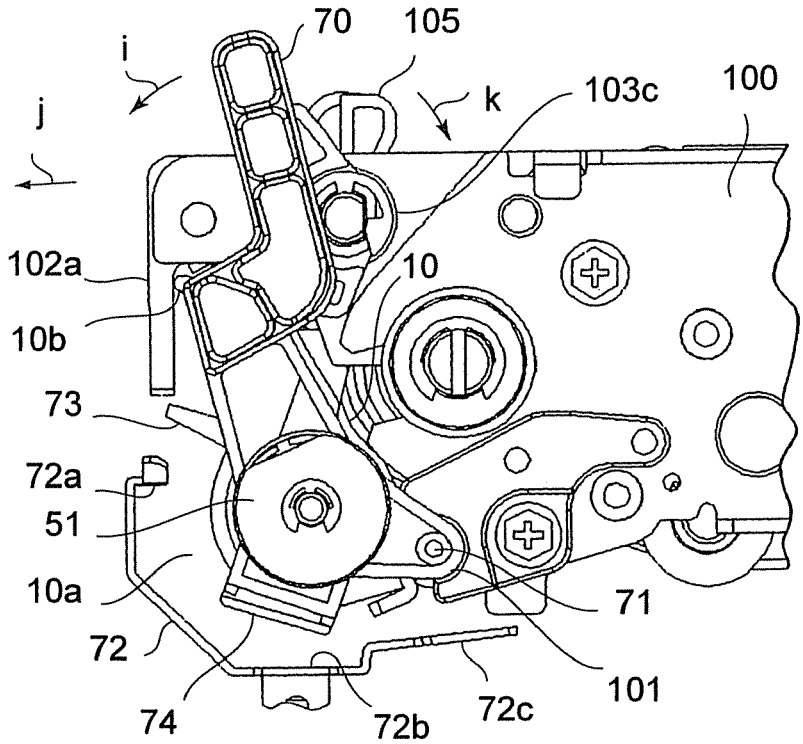
FIG. 5 is a schematic lateral view of the belt cleaner and a cleaner frame disposed at the toner recovery position according to the embodiment of the present invention.
Figure 6:
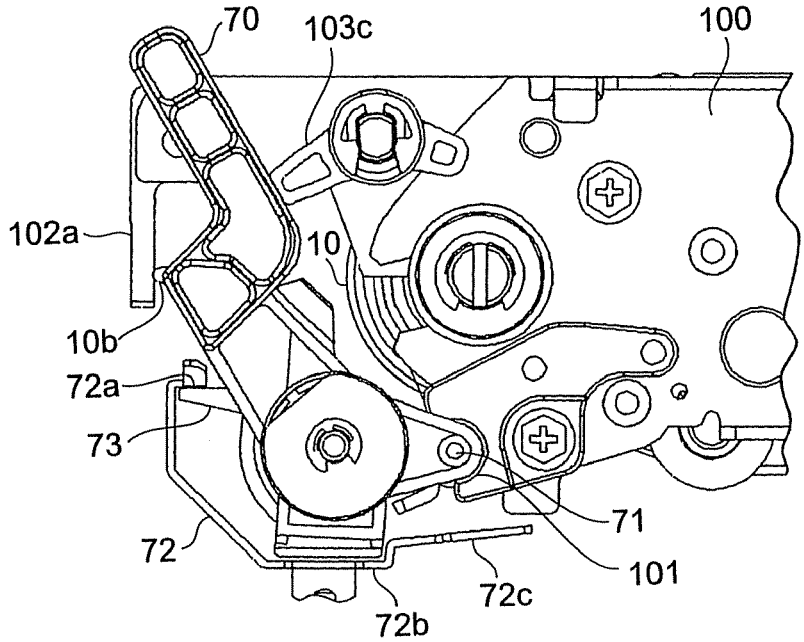
FIG. 6 is a schematic lateral view of the belt cleaner and the cleaner frame disposed at the mounting/dismounting position according to the embodiment of the present invention.
Figure 7:
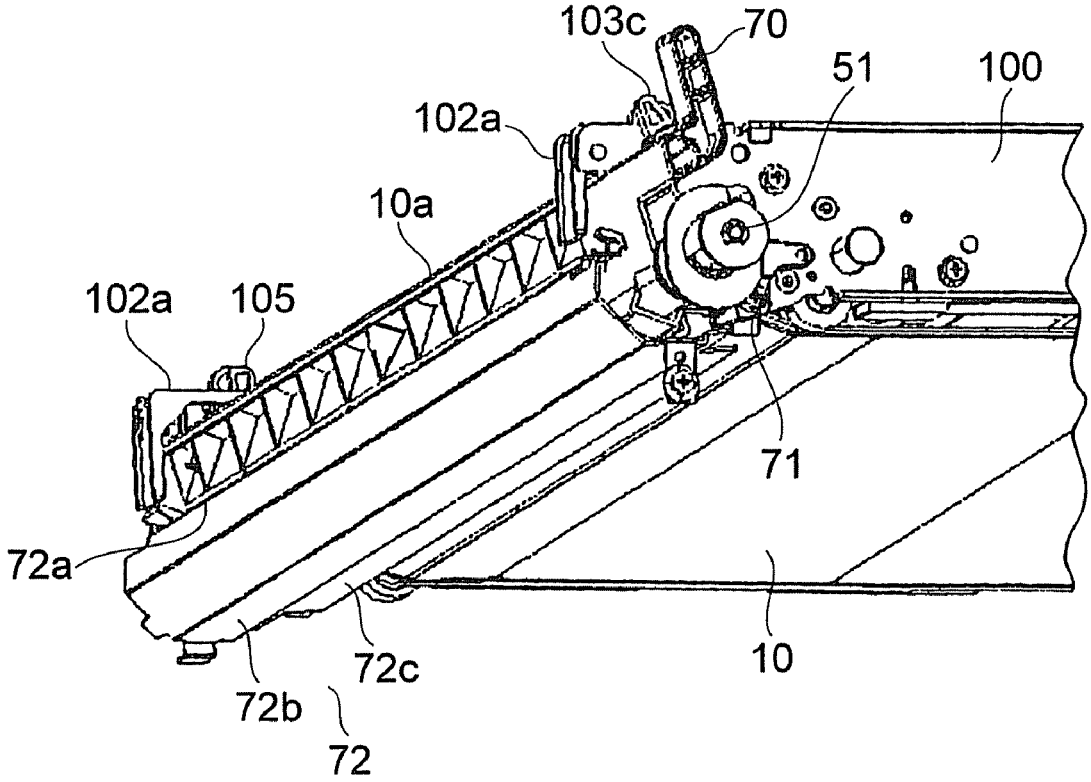
FIG. 7 is a schematic perspective view of the cleaner frame according to the embodiment of the present invention as viewed from the bottom direction.
Figure 8:
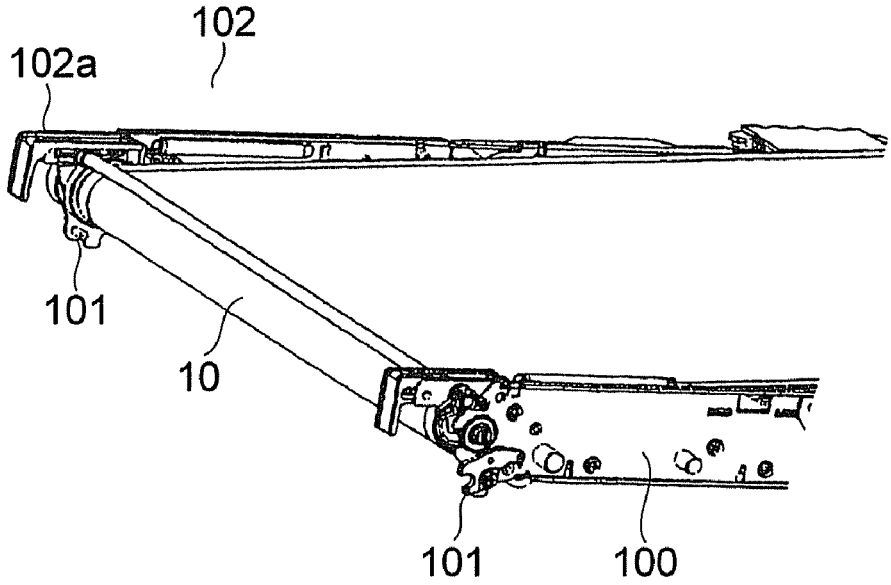
FIG. 8 is a schematic perspective view of part of the intermediate transfer belt according to the embodiment of the present invention, from which the belt cleaner is removed.
Figure 9:
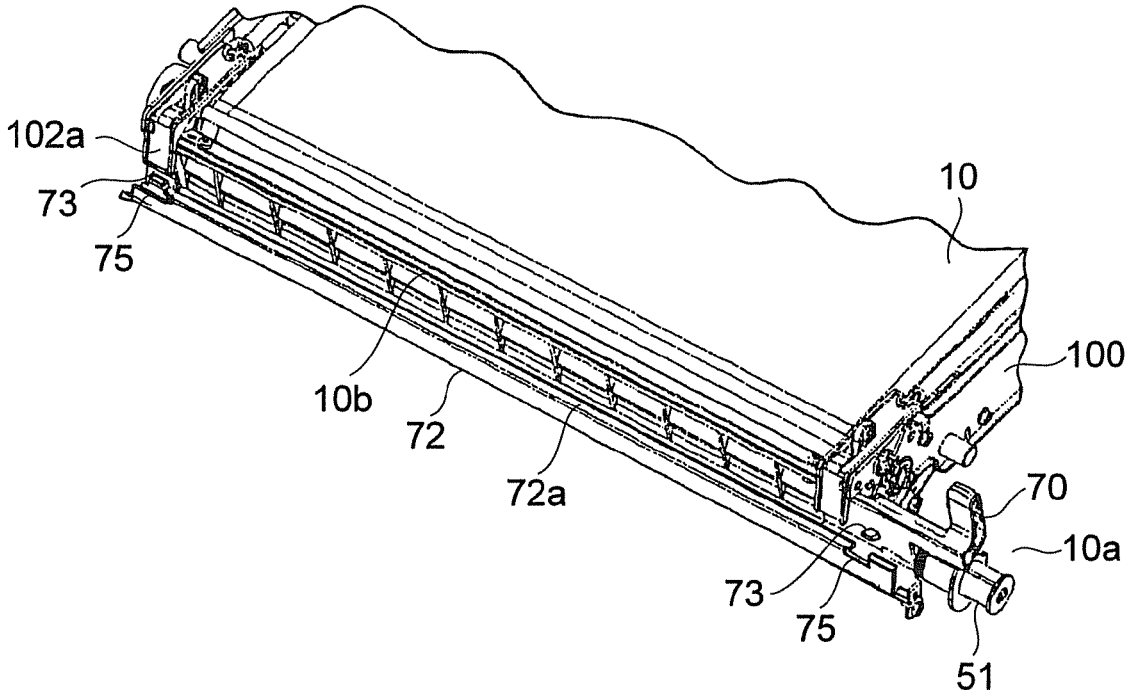
FIG. 9 is a schematic illustration of the arrangement of the cleaner frame and a guide projection of the belt cleaner according to the embodiment of the present invention.
Figure 10:
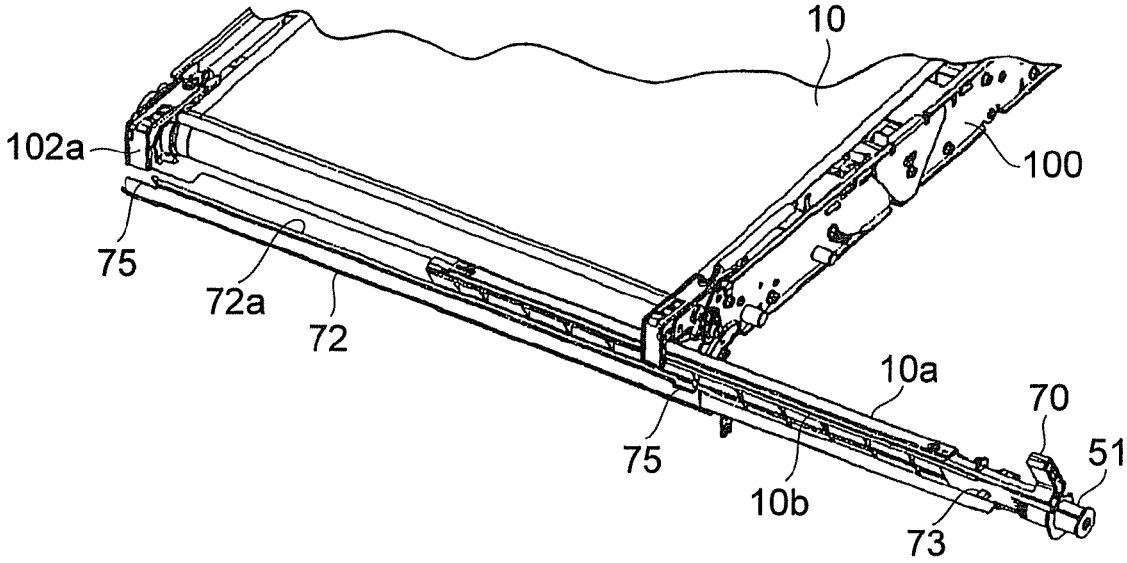
FIG. 10 is a schematic illustration of the arrangement of the cleaner frame and the guide projection of the belt cleaner that is partly drawn out, according to the embodiment of the present invention.

The belt cleaner 10*a* can be arranged selectively at the toner recovery position shown in FIG. 5 and at the mounting/dismounting position shown in FIG. 6 by operating lever 70 and turning it around bosses 71. At the toner recovery position, the cleaning blade 50 is held in contact with the intermediate transfer belt 10 so that it can recover residual toner. At the mounting/dismounting position, the cleaning blade 50 is moved away from the intermediate transfer belt 10. The bosses 71 are supported by respective boss carriers 101 that are fitted to the opposite sides of the belt frame 100 as shown in FIG. 8 and position the belt cleaner 10*a* relative to the intermediate transfer belt 10.

Additionally, a first projection 70*a* and a second projection 70*b* are formed at the front side of the belt cleaner 10*a*. The first projection 70*a* triggers releasing the lock mechanism 103, which will be described later. The second projection 70*b* prevents the belt cleaner 10*a* from being drawn out when placed at the toner recovery position.

A cleaner frame 72 is arranged below the belt cleaner 10*a*. The cleaner frame 72 is a support member for slidably supporting the belt cleaner 10*a* arranged at the mounting/dismounting position as shown in FIGS. 5 and 6. The cleaner frame 72 is supported by the main body frame 1*c* of the color copying machine 1. The cleaner frame 72 has a first guide rail 72*a* and a second guide rail 72*b* as guide members.

The first guide rail 72*a* is adapted to receive and engage with guide projections 73 that are receiving members formed respectively at the front side and the rear side of the belt cleaner 10*a* as viewed in the longitudinal direction thereof. The guide projections 73 are held by the first guide rail 72*a* so as to be able to slide as they are received by and engaged with the first guide rail 72*a*. The first guide rail 72*a* is provided with guide rail grooves 75 as a passage section formed by partly cutting out the guide rail 72*a*. The guide rail grooves 75 are formed so as to allow the guide projections 73 to pass through them when the belt cleaner 10*a* is turned so as to be brought into contact and moved away from the intermediate transfer belt 10. The second guide rail 72*b* holds the bottom surface 74 of the belt cleaner 10*a*, allowing the bottom surface 74 to slide thereon.

The cleaner frame 72 additionally has a toner anti-fall dish 72*c* as a toner receiving section. The toner anti-fall dish 72*c* extends toward the contact region where the intermediate transfer belt 10 and the cleaning blade 50 contact with each other. The toner anti-fall dish 72 is adapted to receive the toner that falls near the cleaning blade 50 when the cleaning blade 50 is brought into contact and moved away from the intermediate transfer belt 10, when the belt cleaner 10*a* is slid, when the intermediate transfer belt 10 is taken out and etc.

Figure 11:
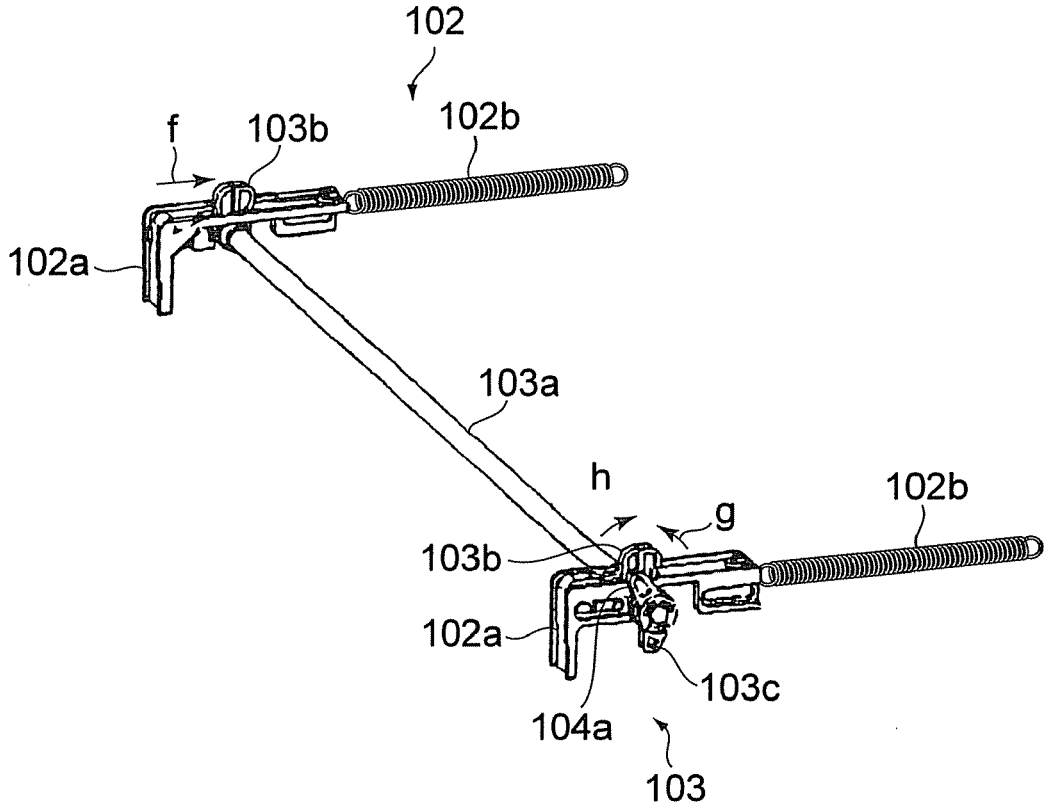
FIG. 11 is a schematic perspective view of a pushing unit and a lock mechanism according to the embodiment of the present invention.

The belt cleaner 10*a* is held to the toner recovery position in the main body frame 1*c* by the elastic force of the pushing units 102 as a pushing member fitted to the opposite lateral sides of the belt frame 100. As shown in FIG. 11, the pushing units 102 respectively include hook members 102*a* that are held in contact with the case rear surface 10*b* of the belt cleaner 10*a* and hook springs 102*b* that are elastic members fitted to the hook members 102*a* so as to pull the latter in the direction indicated by arrow f.

The pushing units 102 are adapted to release the belt cleaner 10*a* by means of the lock mechanism 103 that operates as a release member from the pressure applied to the belt cleaner 10*a*. The lock mechanism 103 includes a lock shaft 103*a* supported by the belt frame 100 and pressure release cams 103*b* fitted respectively to the opposite sides of the lock shaft 103*a*. A boomerang cam 103*c* that is a restoration member, or a restoration cam, is fitted to the front end of the lock shaft 103*a*.

Figure 12:
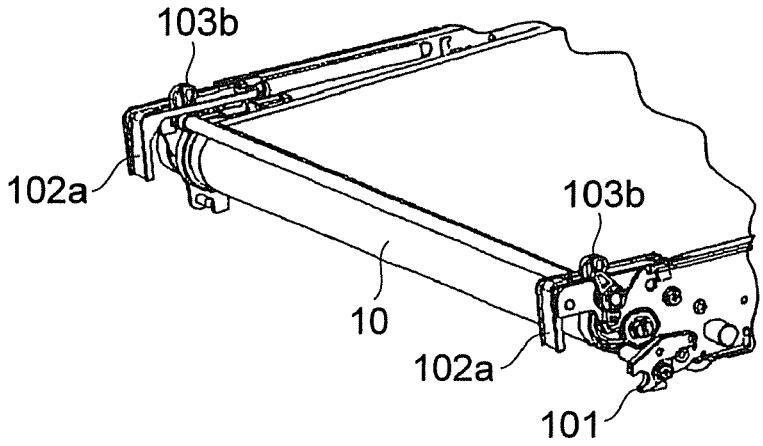
FIG. 12 is a schematic perspective view of part of the pushing unit and the lock mechanism relative to the intermediate transfer belt according to the embodiment of the present invention when the belt cleaner is at the toner recovery position.
Figure 13:
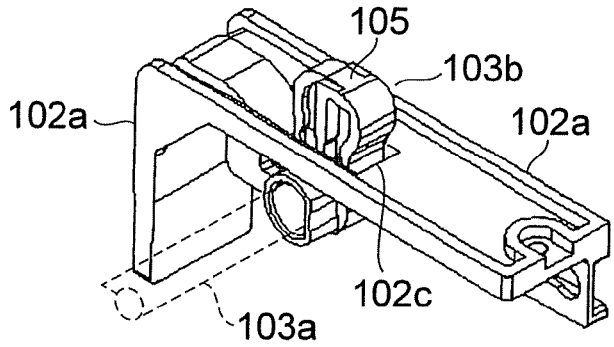
FIG. 13 is a schematic perspective view of a hook member and the lock mechanism according to the embodiment of the present invention when the belt cleaner is at the toner recovery position.

Each of the pressure release cams 103*b* is put in a slit 102*c* formed at the top surface of the corresponding hook member 102*a* and has a substantially flat front end section 105. When the belt cleaner 10*a* is held to the toner recovery position, each of the pressure release cams 103*b* is held stationary with its front end section 105 located at a high position as shown in FIGS. 12 and 13. Therefore, the hook members 102*a* are not restricted by the pressure release cams 103*b* and pulled in the direction of arrow f by the elastic force of the hook springs 102*b*.

Figure 14:
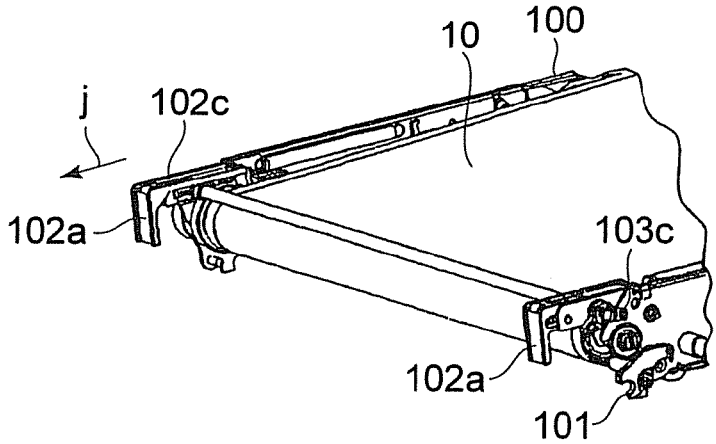
FIG. 14 is a schematic perspective view of part of the pushing unit and the lock mechanism relative to the intermediate transfer belt according to the embodiment of the present invention when the belt cleaner is at the mounting/dismounting position.
Figure 15:
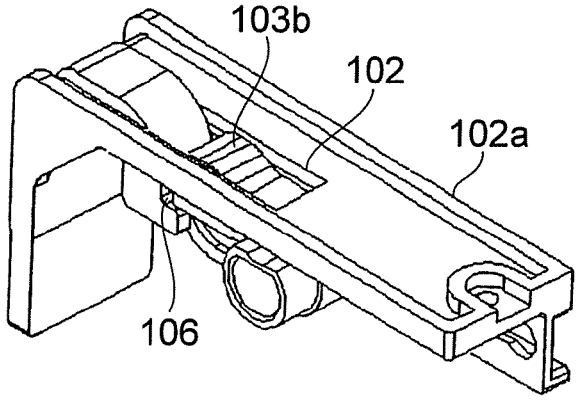
FIG. 15 is a schematic perspective view of the hook member and the lock mechanism according to the embodiment of the present invention when the belt cleaner is at the mounting/dismounting position.

When the belt cleaner 10*a* is held to the mounting/dismounting position, each of the pressure release cams 103*b* is held stationary at the respective release position where the front end section 105 thereof contacts the planar region 106 at the front end of the slit 102*c* formed at the top surface of the hook member 102*a* as shown in FIGS. 14 and 15. Therefore, the hook member 102*a* is pushed in the direction of arrow j with the corresponding pressure release cam 103*b* to release the belt cleaner 10*a* from the pressure applied to it.

The boomerang cam 103*c* is a cam for triggering a clockwise turn of the corresponding pressure release cam 103*b*, which is in the state shown in FIG. 15, in the direction of arrow h in FIG. 11. As the second projection 70*b* of the belt cleaner 10*a* contacts the first end section 104*a* of the boomerang cam 103*c*, the boomerang cam 103*c* is forced to turn in the direction of arrow h to turn the corresponding pressure release cam 103*b* in the direction of arrow h via the lock shaft 103*a*. Then, as a result, the pressure release cam 103*b* is taken out from the release position.

Now, the operation of the above-arrangement will be described below. When an image forming process is started, the belt cleaner 10*a* is at the toner recovery position as shown in FIG. 5 and the cleaning blade 50 contacts the intermediate transfer belt 10 to recover the residual toner on the intermediate transfer belt 10.

As the image forming process is started in this condition, image information is input from a scanner, a personal computer terminal or the like and the photosensitive drums 12Y, 12M, 12C and 12K are driven to rotate so that the image forming steps are sequentially brought into effect in the image forming units 11Y, 11M, 11C and 11K. In the yellow (Y) image forming unit 11Y, the surface of the photosensitive drum 12Y is uniformly charged with electricity by the electric charger 13Y.

Subsequently, an electrostatic latent image is formed on the photosensitive drum 12Y as the photosensitive drum 12Y is irradiated with a laser beam that corresponds to the image information for yellow (Y) at the exposure position 17Y. Thereafter, a toner image is formed on the photosensitive drum 12Y by the development units 14Y. Then, the photosensitive drum 12Y contacts the intermediate transfer belt 10 that is being turned in the direction of arrow s to transfer the toner image onto the intermediate transfer belt 10 for primary transfer by means of the primary transfer roller 18Y.

A toner image forming process is executed for each of the colors of magenta (M), cyan (C) and black (K) like the toner image forming process for yellow (Y). The toner images formed respectively on the photosensitive drums 12M, 12C and 12K are sequentially transferred and laid on the yellow (Y) toner image one on the other on the intermediate transfer belt 10. Thus, a full color toner image is formed on the intermediate transfer belt 10 as a result of multiply transferring the toner images of yellow (Y), magenta (M), cyan (C) and black (K).

The full color toner image formed by laying the monochromatic toner images one on the other gets to the position of the secondary transfer roller 27. Then, the full color toner image on the intermediate transfer belt 10 is transferred onto a sheet of paper P in a batch due to the transfer bias voltage of the secondary transfer roller 27. The toner image is finished when the sheet of paper P passes through the fixing step. After the fixing step, the sheet of paper P is discharged to the inter-body sheet ejecting section 3 when it is for single side printing. When, on the other hand, the sheet of paper P is for double side printing or multiplex printing, it is conveyed back to the position of the secondary transfer roller 27 by way of a reconveyance unit (not shown).

Meanwhile, the intermediate transfer belt 10 is cleaned off the residual toner by the belt cleaner 10*a* after the end of the secondary transfer. On the other hand, the photosensitive drums 12Y, 12M, 12C and 12K are cleaned off the respective residual toners by the photosensitive member cleaning apparatus 16Y, 16M, 16C and 16K after transferring the respective toner images onto the intermediate transfer belt 10 for primary transfer to make them ready for the next image forming process.

The belt cleaner 10*a* conveys the waste toner recovered from the intermediate transfer belt 10 by means of the cleaning blade 50 that is held in contact with the intermediate transfer belt 10 to the front side by means of the auger 51. The waste toner that is conveyed to the front side is then flowed into the waste toner box 30 by way of the duct 32 for accumulation.

If there arises an occasion where a maintenance operation of replacing the belt cleaner 10*a* or some other operation has to intervene while the image forming process is in progress, the used belt cleaner 10*a* is taken out from and a new belt cleaner 10*a* is mounted on the main body frame 1*c* in a manner as described below.

(Operation of Taking Out Used Belt Cleaner 10*a*)

Firstly, the front cover 1*a* is opened and the duct 32 is taken out. Then, the lever 70 is turned in the direction of arrow i and then the belt cleaner 10*a* is turned around the bosses 71 that operate as fulcrums. As a result, the used belt cleaner 10*a* is moved away from the intermediate transfer belt 10 and placed at the mounting/dismounting position.

As the belt cleaner 10*a* is turned in the direction of arrow i, the case rear surface 10*b* pushes the hook members 102*a* to slide the hook members 102*a* in the direction of arrow j against the elastic force of the hook springs 102*b*. As the hook members 102*a* slide in the direction of arrow j, the pressure release cams 103*b* are pushed by the rear ends of the slits 102*c* to turn in the direction of arrow g shown in FIG. 11. Thereafter, the front end sections 105 of the pressure release cams 103*b* get to the respective positions shown in FIG. 15 and held standing stationary at the respective release positions where they contact the corresponding planar regions 106 in the respective slits 102*c*. As a result the pressure being applied to the belt cleaner 10*a* by the pushing units 102 is removed.

As the belt cleaner 10*a* is turned from the toner recovering position to the mounting/dismounting position, the guide projections 73 of the belt cleaner 10*a* pass the respective guide rail grooves 75 and become so positioned as to be able to be engaged with the first guide rail 72*a* of the cleaner frame 72. On the other hand, the bottom surface 74 of the belt cleaner 10*a* is received in the second guide rail 72*b*.

In this condition, the used belt cleaner 10*a* is driven to slide in the direction toward the front side of the main body frame 10*a* that is a direction perpendicular to the running direction of the intermediate transfer belt 10 as indicated by arrow s and taken out from the main body frame 10*c*. If toner spills out from the cleaning blade 50 at this time, it is received by the toner anti-fall dish 72*c*. Therefore, the spilled toner does not taint the surrounding. While the belt cleaner 10*a* is being taken out from the main body frame 10*c*, the hook members 102*a* maintain the situation where the belt cleaner 10*a* is released from the pressure they apply to it due to the pressure release cams 103*b*.

(Operation of Fitting New Belt Cleaner 10*a*)

Then, a new belt cleaner 10*a* is brought into engagement with the first guide rail 72*a* and the second guide rail 72*b* and driven to slide in the direction of being mounted in the cleaner frame 72. As the first projection 70 of the cleaner frame 72 gets to the position of the boomerang cam 103*c*, it contacts the first end section 104*a* and starts turning the lock shaft 103*a* in the direction of arrow h with the first end section 104*a*.

As the lock shaft 103*a* is turned in the direction of arrow h, the front end sections 105 of the pressure release cams 103*b* are taken out from the respective release positions where they contact the planar regions 106 in the inside of the corresponding slits 102*c* of the respective hook members 102*a*. The hook members 102*a* are subjected to force directed in the direction of arrow f due to the elastic force of the hook springs 102*b*. Therefore, as the front end sections 105 of the pressure release cams 103*b* leave the respective planar regions 106, the pressure release cams 103*b* are subjected to force directed in the direction of arrow f by the corresponding slits 102*c* of the respective hook members 102*a* and turned gradually in the direction of arrow h.

As a result, the hook members 102*a* push the case rear surface 10*b* of the belt cleaner 10*a* to turn the latter around the bosses 71, which operate as fulcrums, in the direction of arrow k. When the first projection 70 gets to the position of the boomerang cam 103*c*, the guide projections 73 of the belt cleaner 10*a* get to the positions of the respective guide rail grooves 75 of the first guide rail 72*a*. Therefore, as the belt cleaner 10*a* is turned in the direction of arrow k, the guide projections 73 leave the first guide rail 72*a* by way of the respective guide rail grooves 75.

Additionally, due to the pressure in the direction of allow f being applied by the hook members 102*a*, the cleaning blade 50 of the belt cleaner 10*a* contacts the intermediate transfer belt 10 so as to be able to recover the residual toner on the intermediate transfer belt 10 and make the intermediate transfer belt 10 ready for the next image forming process. At this time, the second projection 70*b* is at a position where it interferes with the main body frame 11*c* so as to prevent the belt cleaner 10*a* from being drawn out from the main body frame while the cleaning blade 50 is held in contact with the intermediate transfer belt 10.

The above-described embodiment has pressure release cams 103*b* that are interlocked with the belt cleaner 10*a* when the latter is turned and a boomerang cam 103*c* that is interlocked with a belt cleaner 10*a* when the latter is mounted. When the belt cleaner 10*a* is replaced, the pressure release cams 103*b* are held standing stationary at the respective release positions while the belt cleaner 10*a* is turned. As a result, the pressure of the pushing units 102 that urges the belt cleaner 10*a* toward the intermediate transfer belt is released. Thus, the belt cleaner 10*a* can be mounted/dismounted without contacting and damaging the intermediate transfer belt 10 and without any interference of the pushing units 102.

The boomerang cam 103*c* starts turning as it is interlocked with the belt cleaner 10*a* when the latter is being mounted so that the pressure release cams 103*b* are taken out from the respective release positions and subsequently the belt cleaner 10*a* is urged toward the intermediate transfer belt by the pushing units 102.

Thus, when only the belt cleaner 10*a* is mounted and dismounted independently without taking out the intermediate transfer belt 10, the belt cleaner 10*a* does not contact the intermediate transfer belt 10 to damage the latter. Then, it is possible to replace only the belt cleaner 10*a* safely and easily to consequently improve the maintenance capability of the color copying machine.

The guide rail grooves 75 are formed on the first guide rail 72*a* of this embodiment to facilitate the operation of moving the belt cleaner 10*a* when the belt cleaner 10*a* is brought into contact and moved away from the intermediate transfer belt 10. Additionally, when the belt cleaner 10*a* is moved away from the intermediate transfer belt 10, the guide projections 73 of the belt cleaner 10*a* can easily be brought into engagement with the first guide rail 72*a*. Then, the belt cleaner 10*a* can be easily mounted and dismounted by sliding the guide projections 73 along the first guide rail 72*a*.

Thus, when only the belt cleaner 10*a* is mounted and dismounted independently without taking out the intermediate transfer belt 10, the belt cleaner 10*a* does not contact the intermediate transfer belt 10 to damage the latter. In other words, it is possible to replace only the belt cleaner 10*a* safely and easily to consequently improve the maintenance capability of the color copying machine.

Additionally, with the above-described embodiment, it is possible to mount and dismount only the belt cleaner 10*a* independently without taking out the intermediate transfer belt 10 once the belt cleaner 10*a* is moved away from the intermediate transfer belt 10. Thus, it is possible to replace only the belt cleaner 10*a* alone with ease to improve the maintenance capability. Furthermore, the cleaner frame 72 that has the first and second guide rails 72*a*, 72*b* for guiding the belt cleaner 10*a* when it is mounted and dismounted is equipped with a toner anti-fall dish 72*c*. Therefore, if toner falls from the vicinity of the cleaning blade 50 when only the belt cleaner 10*a* is being replaced, it is received by the toner anti-fall dish 72*c* to prevent the surrounding units from being tainted by the falling toner. Still additionally, since the toner anti-fall dish 72*c* is formed integrally with the first and second guide rails 72*a*, 72*b* for guiding the belt cleaner 10*a* when it is mounted and dismounted, some of the their parts as well as the fitting positions thereof can be commonly used to reduce the cost and size of the overall machine.

The present invention is by no means limited to the above-described embodiment, which may be modified and altered in various different ways without departing from the spirit and scope of the present invention. For example, the release members are not limited to those described above in terms of structure and other factors so long as they are interlocked with the cleaning member to become able to release the pressure applied by the pushing members. The restoration members are also not limited those described above in terms of structure and other factors so long as they are interlocked with the cleaning member when the latter is mounted to become able to restore the release members and also the pushing members to the respective toner recovering positions.

What is claimed is:

1. An image forming apparatus comprising:

a plurality of image forming units having respectively toner image forming means for forming toner images on corresponding image carriers;

an endless belt member arranged opposite to the image carriers to bear and move the toner images transferred from the image carriers as primary transfer and transfer them on a transfer medium;

a cleaning member holding a cleaning blade, the cleaning blade being adapted to be brought into contact with and moved away from the belt member, and arranged opposite to the belt member after transferring the toner images to the transfer medium, the cleaning member capable of being mounted and dismounted independently relative to the belt member;

a pushing member movable between a toner recovering position and a mounting/dismounting position and adapted to push the cleaning member in the direction toward the belt member at the toner recovering position so as to bring the cleaning blade into contact with the belt member;

a release member having a pressure release cam rotated and stand still in a release position by an operation of moving the cleaning blade away from the belt member to move the pushing member from the toner recovering position to the mounting/dismounting position and release the pressure being applied to the cleaning member; and a restoration member having a restoration cam rotated by an operation of contacting with the cleaning member when the cleaning member is mounted and takes out the pressure release cam from the release position interlocked with the rotation of the restoration cam to move the pushing member from the mounting/dismounting position to the toner recovering position.

2. The image forming apparatus according to claim 1, wherein the pushing member has a hook member to be held in contact with the cleaning member and a elastic member for pulling the hook member in the direction toward the belt member; and the release member adapted to pull the hook member in a direction opposite to the direction toward the belt member with the operation of moving the cleaning blade away from the belt member and the pressure release cam stand still in a release position.

3. The image forming apparatus according to claim 2, wherein the direction perpendicular to the running direction of the belt member is the frontward direction of the image forming apparatus.

4. The image forming apparatus according to claim 1, wherein the pressure release cam and the restoration cam are fitted to a same shaft.

5. The image forming apparatus according to claim 1, wherein the cleaning member has a projection member adapted to be brought into contact with the restoration cam so as to turn it in the mounting operation.

6. The image forming apparatus according to claim 1, wherein the belt member is arranged above the plurality of image forming units and the lower side of the belt member faces the image carriers.

7. The image forming apparatus according to claim 1, wherein the mounting/dismounting direction is a direction perpendicular to the running direction of the belt member.

8. The image forming apparatus according to claim 7, wherein the direction perpendicular to the running direction of the belt member is the front direction of the image forming apparatus.

9. The image forming apparatus according to claim 1, further comprising:

a toner anti-fall dish extending below the contact region of the belt member and the cleaning member.

10. An image forming apparatus comprising:

a plurality of image forming units having respectively toner image forming means for forming toner images on corresponding image carriers;

an endless belt member arranged opposite to the image carrier members to bear and move the toner images transferred from the image carriers as primary transfer and transfer them on a transfer medium;

a cleaning member holding a cleaning blade, the cleaning blade being adapted to be brought into contact with and moved away from the belt member, and arranged opposite to the belt member after transferring the toner images to the transfer medium, the cleaning member capable of being mounted and dismounted independently relative to the belt member;

a pushing member movable between a toner recovering position and a mounting/dismounting position and adapted to push the cleaning member in the direction toward the belt member at the toner recovering position so as to bring the cleaning blade into contact with the belt member;

a release member having a pressure release cam rotated and stand still in a release position by an operation of moving the cleaning blade away from the belt member to move the pushing member from the toner recovering position to the mounting/dismounting position and release the pressure being applied to the cleaning member;

a restoration member having a restoration cam rotated by an operation of contacting with the cleaning member when the cleaning member is mounted and takes out the pressure release cam from the release position interlocked with the rotation of the restoration cam to move the pushing member from the mounting/dismounting position to the toner recovering position;

a guide member for guiding the cleaning member in the mounting/dismounting direction thereof;

a receiving member arranged at the cleaning member and adapted to be guided by the guide member in an operation of mounting/dismounting the cleaning member; and a passage section formed at the guide member to allow the receiving member to pass through at the time of brining the cleaning member into contact with and moving it away from the belt member.

11. An image forming apparatus comprising:

a plurality of image forming units having respectively toner image forming means for forming toner images on corresponding image carriers;

an endless belt member arranged opposite to the image carriers to bear and move the toner images transferred from the image carriers as primary transfer and transfer them on a transfer medium;

a cleaning member arranged opposite to the endless belt member so as to be capable of being brought into contact with and moved away from the belt member after transferring the toner images on the transfer medium and adapted to be moved away from the belt member independently relative to the belt member for mounting/dismounting operations;

a pushing member movable between a toner recovering position and a mounting/dismounting position and adapted to push the cleaning member in the direction toward the belt member at the toner recovering position so as to bring the cleaning blade into contact with the belt member;

a release member having a pressure release cam rotated and stand still in a release position by an operation of moving the cleaning blade away from the belt member to move the pushing member from the toner recovering position to the mounting/dismounting position and release the pressure being applied to the cleaning member;

a restoration member having a restoration cam rotated by an operation of contacting with the cleaning member when the cleaning member is mounted and takes out the pressure release cam from the release position interlocked with the rotation of the restoration cam to move the pushing member from the mounting/dismounting position to the toner recovering position;

a guide member for guiding the cleaning member in the mounting/dismounting direction thereof;

a receiving member arranged at the cleaning member and adapted to be guided by the guide member in an operation of mounting/dismounting the cleaning member; and a passage section formed at the guide member to allow the receiving member to pass through at the time of bringing the cleaning member into contact with and moving it away from the belt member.

12. The image forming apparatus according to claim 11, wherein the passage section is formed by cutting out part of the guide member.

13. The image forming apparatus according to claim 12, wherein the plurality of receiving members are arranged in the longitudinal direction of the cleaning member and the plurality of passage sections are formed at the guide member to correspond to the plurality of receiving members.

* * * * *